US012221680B2

(12) United States Patent
Lee et al.

(10) Patent No.: US 12,221,680 B2
(45) Date of Patent: Feb. 11, 2025

(54) CRYOGENIC AUSTENITIC HIGH-MANGANESE STEEL HAVING EXCELLENT CORROSION RESISTANCE, AND MANUFACTURING METHOD THEREFOR

(71) Applicant: POSCO, Pohang-si (KR)

(72) Inventors: Un-Hae Lee, Gwangyang-si (KR); Dong-Ho Lee, Gwangyang-si (KR); Sang-Deok Kang, Gwangyang-si (KR); Sung-Kyu Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 814 days.

(21) Appl. No.: 17/283,884

(22) PCT Filed: Oct. 25, 2019

(86) PCT No.: PCT/KR2019/014197
§ 371 (c)(1),
(2) Date: Apr. 8, 2021

(87) PCT Pub. No.: WO2020/085864
PCT Pub. Date: Apr. 30, 2020

(65) Prior Publication Data

US 2021/0388475 A1 Dec. 16, 2021

(30) Foreign Application Priority Data

Oct. 25, 2018 (KR) ..... 10-2018-0128505
Oct. 25, 2019 (KR) ..... 10-2019-0133780

(51) Int. Cl.

| | |
|---|---|
| ***C22C 38/38*** | (2006.01) |
| ***C21D 8/02*** | (2006.01) |
| ***C22C 38/02*** | (2006.01) |
| ***C22C 38/06*** | (2006.01) |
| ***C22C 38/20*** | (2006.01) |
| ***C22C 38/32*** | (2006.01) |

(52) U.S. Cl.
CPC ..... *C22C 38/38* (2013.01); *C21D 8/0205* (2013.01); *C21D 8/0226* (2013.01); *C22C 38/02* (2013.01); *C22C 38/06* (2013.01); *C22C 38/20* (2013.01); *C22C 38/32* (2013.01); *C21D 2211/001* (2013.01)

(58) Field of Classification Search
CPC ..... C22C 38/38
See application file for complete search history.

(56) References Cited

U.S. PATENT DOCUMENTS

2002/0121318 A1* 9/2002 Morito ..... C21D 8/0205 148/620
2016/0271739 A1* 9/2016 Lee ..... C22C 38/50
2018/0363108 A1 12/2018 Lee et al.
2019/0323108 A1 10/2019 Bae
2020/0263268 A1* 8/2020 Ha ..... C21D 8/02

FOREIGN PATENT DOCUMENTS

| | | | |
|---|---|---|---|
| CN | 106222554 | A | 12/2016 |
| CN | 107177786 | A | 9/2017 |
| CN | 107620010 | A | 1/2018 |
| EP | 1649069 | B1 | 4/2017 |
| JP | 56023259 | A | 5/1981 |
| JP | 2007-126715 | A | 5/2007 |
| JP | 2014-088611 | A | 5/2014 |
| JP | 2016-196703 | A | 11/2016 |
| KR | 10-2006-0040718 | A | 5/2006 |
| KR | 10-2012-0071911 | A | 7/2012 |
| KR | 10-2015-0075324 | A | 7/2015 |
| KR | 10-2016-0078664 | A | 7/2016 |
| KR | 10-2017-0075657 | A | 7/2017 |
| KR | 10-2018-0068542 | A | 6/2018 |
| KR | 10-2018-0072967 | A | 7/2018 |
| KR | 10-2018-0074450 | A | 7/2018 |
| WO | 2017/111510 | A1 | 6/2017 |

OTHER PUBLICATIONS

Machine translation of CN106222554A (Chinese laguage document published Dec. 14, 2016.*
Chinese Office Action dated Nov. 29, 2022 issued in Chinese Patent Application No. 201980069600.4 (with English translation).
Cai Kaike, "Quality Control of Continuous Casting Slab," Metallurgical Industry Press, p. 226, published on May 31, 2010 (with partial English translation).
International Search Report dated Feb. 7, 2020 issued in International Patent Application No. PCT/KR2019/014197 (with English translation).
Extended European Search Report dated Jul. 1, 2017 issued in European Patent Application No. 19875923.5.

* cited by examiner

*Primary Examiner* — Christopher S Kessler
(74) *Attorney, Agent, or Firm* — Morgan, Lewis & Bockius LLP

(57) ABSTRACT

The cryogenic austenitic high-manganese steel having excellent corrosion resistance, according to one aspect of the present invention, comprises 0.2-0.5 wt % of C, 23-28 wt % of Mn, 0.05-0.5 wt % of Si, 0.03 wt % or less of P, 0.005 wt % or less of S, 0.5 wt % or less of Al, and 3-4 wt % of Cr, with the remainder being Fe and other unavoidable impurities, also comprises at least 95 area % of austenite as a microstructure, and has Cr concentration sections continuously formed within an area of 50 μm in the thickness direction from the surface, wherein the Cr concentration sections comprise a high Cr concentration section having a relatively high concentration of Cr, and a low Cr concentration section having a relatively low concentration of Cr, and the high Cr concentration section may be distributed at 30 area % or less (but not 0%) relative to the whole surface area of the Cr sections.

13 Claims, No Drawings

CRYOGENIC AUSTENITIC HIGH-MANGANESE STEEL HAVING EXCELLENT CORROSION RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/014197, filed on Oct. 25, 2019, which in turn claims the benefit of Korean Application Nos. 10-2018-0128505, filed on Oct. 25, 2018 and 10-2019-0133780, filed on Oct. 25, 2019, the entire disclosures of which applications are incorporated by reference herein.

TECHNICAL FIELD

The present disclosure relates to an austenitic high-manganese steel material and a method of manufacturing the same, and more particularly, an austenitic high-manganese steel material having excellent cryogenic toughness and excellent corrosion resistance, and a method of manufacturing the same.

BACKGROUND ART

As regulations on environmental pollution have been strengthened, and depletion of petroleum energy has been expected, demand for eco-friendly energy such as LNG and LPG has increased as alternative energy, and interest in development of use technology has increased. As demand for low-polluting fuels such as LNG and LPG, which may be transported in a low-temperature liquid state, has increased, development of materials for low-temperature structures for storage and transportation thereof has been actively conducted. A material for a low-temperature structure may require mechanical properties such as low-temperature strength and toughness, and the most representative material for a low-temperature structure may include 9% Ni steel material or 304 stainless steel material.

9% Ni steel material may exhibit excellent properties in terms of weldability and economic efficiency, but may have a level of corrosion resistance similar to that of a general carbon steel material, and therefore, particularly, application thereof in an environment accompanied with deformation and corrosion may not be preferable. Also, while a 304 stainless steel material has excellent corrosion resistance properties; there may be technical difficulties in terms of securing economic efficiency and low-temperature properties. Therefore, it may be urgent to develop a material having excellent low-temperature properties and excellent corrosion resistance.

PRIOR ART DOCUMENT (Reference 1) Korean Laid-Open Patent Publication No. 10-2015-0075324 (publicized on Jul. 3, 2015)

DISCLOSURE

Technical Problem

An aspect of the present disclosure is to provide a cryogenic austenitic high-manganese steel material having excellent corrosion resistance and a method of manufacturing the same.

The purpose of the present disclosure is not limited to the above description. A person skilled in the art would have no difficulty in understanding the additional purpose of the present disclosure from the overall description in the present specification.

Technical Solution

A cryogenic austenitic high-manganese steel material having excellent corrosion resistance according to an aspect of the present disclosure includes, by weight %, 0.2-0.5% of C, 23-28% of Mn, 0.05-0.5% of Si, 0.03% or less of P, 0.005% or less of S, 0.5% or less of Al, 3-4% of Cr, and a balance of Fe and inevitable impurities; 95 area % or more of austenite as a microstructure; and a Cr concentration section continuously formed in an area within 50 μm from a surface in a thickness direction, wherein the Cr concentration section includes a high Cr concentration section in which Cr is concentrated in a relatively high concentration and a low Cr concentration section in which Cr is concentrated in a relatively low concentration, and wherein the high Cr concentration section is distributed in a fraction of 30 area % or less (excluding 0%) relative to an entire surface area of the Cr concentration section.

The steel material may include, by weight %, one or more elements selected from among 1% or less of Cu (excluding 0%) and 0.0005-0.01% of B.

The high Cr concentration section may refer to an area including Cr by more than 1.5 times the Cr content of the steel material, and the low Cr concentration section may refer to an area including Cr by more than 1 time and 1.5 times or less the Cr content of the steel material.

The high Cr concentration section may be distributed in a fraction of 10 area % or less relative to an entire surface area of the Cr concentration section.

A grain size of austenite may be 5-150 μm.

Tensile strength of the steel material may be 400 MPa or more, yield strength of the steel material may be 800 MPa or more, and elongation of the steel material may be 40% or more.

The steel material may have a Charpy impact toughness of 90 J or more (based on a 10 mm sample thickness) at −196° C., and corrosion loss of 80 mg/cm$^2$ or less in a corrosion resistance test according to ISO9223.

A method of manufacturing cryogenic austenitic high-manganese steel material having excellent corrosion resistance according to an aspect of the present disclosure includes reheating a slab including, by weight %, 0.2-0.5% of C, 23-28% of Mn, 0.05-0.5% of Si, 0.03% or less of P, 0.005% or less of S, 0.5% or less of Al, 3-4% of Cr, and a balance of Fe and inevitable impurities, in a temperature range of 1050-1300° C.; hot-rolling the reheated slab at a finishing rolling temperature of 900-950° C., thereby providing an intermediate material; and cooling the intermediate material to a temperature range of 600° C. or less at a cooling rate of 1-100° C./s, thereby providing a final material.

The slab may further include, by weight %, one or more elements selected from among 1% or less of Cu (excluding 0%) and 0.0005-0.01% of B.

The means for solving the above problems do not list all of the features of the present invention, and various features of the present invention and advantages and effects thereof will be understood in greater detail with reference to the specific embodiments as below.

ADVANTAGEOUS EFFECTS

According to preferable an aspect of the present disclosure, cryogenic austenitic high-manganese steel material having excellent cryogenic toughness and having excellent corrosion resistance, and a method of manufacturing the same may be provided.

BEST MODE FOR INVENTION

The present disclosure relates to a cryogenic austenitic high-manganese steel material having excellent corrosion resistance and a method of manufacturing the same, and hereinafter, preferable embodiments of the present disclosure will be described. Embodiments of the present disclosure may be modified in various forms, and the scope of the present disclosure should not be construed as being limited to the embodiments described below. The embodiments are provided to further describe the present disclosure to a person skilled in the art to which the present disclosure pertains.

Hereinafter, a steel composition in the present disclosure will be described in greater detail. Hereinafter, "%" indicating a content of each element may be based on weight unless otherwise indicated.

The cryogenic austenitic high-manganese steel material having excellent corrosion resistance according to an aspect of the present disclosure may include 0.2-0.5% of C, 23-28% of Mn, 0.05-0.5% of Si, 0.03% or less of P, 0.005% or less of S, 0.5% or less of Al, 3-4% of Cr, and a balance of Fe and inevitable impurities.

Carbon (C): 0.2-0.5%

Carbon (C) may be effective in stabilizing austenite in a steel material and securing strength by solid solution strengthening. Accordingly, in the present disclosure, a lower limit of the carbon (C) content may be limited to 0.2% to secure low-temperature toughness and strength. In other words, when the carbon (C) content is less than 0.2%, austenite stability may be insufficient such that stable austenite may not be obtained at cryogenic temperature, and processing organic transformation into ε-martensite and α'-martensite may easily occur by external stress such that toughness and strength of the steel material may be reduced. When the carbon (C) content exceeds a certain range, toughness of the steel material may be rapidly deteriorated due to precipitation of carbides, and strength of the steel material may excessively increase such that workability of the steel material may significantly degrade. Thus, an upper limit of the carbon (C) content may be limited to 0.5%. Therefore, the carbon (C) content in the present disclosure may be 0.2-0.5%. A preferable carbon (C) content may be 0.3-0.5%, and a more preferable carbon (C) content may be 0.35-0.5%.

Manganese (Mn): 23-28%

Manganese (Mn) may be an important element which may stabilize austenite, and accordingly, in the present disclosure, a lower limit of the manganese (Mn) content may be limited to 23% to obtain the effect as above. In other words, since 23% or more of 23% manganese (Mn) may be included in the present disclosure, stability of austenite may effective increase, such that the formation of ferrite, ε-martensite, and α'-martensite may be inhibited, thereby effectively securing low-temperature toughness of the steel material. When the manganese (Mn) content exceeds a certain level, the effect of increasing stability of austenite may be saturated, but manufacturing costs may greatly increase, and internal oxidation may excessively occur during hot-rolling, such that surface quality may be deteriorated. Thus, an upper limit of the manganese (Mn) content may be limited to 28%. Accordingly, the manganese (Mn) content in the present disclosure may be 23-28%, and a more preferable manganese (Mn) content may be 23-25%.

Silicon (Si): 0.05-0.5%

Silicon (Si) may be a deoxidizing agent as aluminum (Al) and may be inevitably added in a small amount. When silicon (Si) is excessively added, oxide may be formed on a grain boundary such that high-temperature ductility may be reduced, and cracks may be created such that surface quality may be deteriorated. Thus, an upper limit of the silicon (Si) content may be limited to 0.5%. Since excessive costs may be required to reduce the silicon (Si) content in steel, a lower limit of the silicon (Si) content may be limited to 0.05% in the present disclosure. Therefore, the silicon (Si) content in the present disclosure may be 0.05-0.5%.

Phosphorus (P): 0.03% or Less

Phosphorus (P) may be easily segregated and may cause cracking during casting or may degrade weldability. Accordingly, in the present disclosure, an upper limit of the phosphorus (P) content may be limited to 0.03% to prevent deterioration of castability and weldability. Also, in the present disclosure, a lower limit of the phosphorus (P) content may not be particularly limited, but may be limit to 0.001% in consideration of steel making burden.

Sulfur (S): 0.005% or Less

Sulfur (S) may cause a hot brittleness defect by forming inclusions. Accordingly, in the present disclosure, an upper limit of the sulfur (S) content may be limited to 0.005% to inhibit hot brittleness. Also, in the present disclosure, a lower limit of the sulfur (S) content may not be particularly limited, but may be limited to 0.0005% in consideration of steel making burden.

Aluminum (Al): 0.05% or Less

Aluminum (Al) may be a representative element added as a deoxidizer. Accordingly, in the present disclosure, a lower limit of the aluminum (Al) content may be limited to 0.001%, and more preferably to 0.005% to obtain the effect as above. Aluminum (Al), however, may form precipitates by reacting with carbon (C) and nitrogen (N), and hot workability may be deteriorated by the precipitates. Thus, an upper limit of the aluminum (Al) content may be limited to 0.05%. A more preferable upper limit of the aluminum (Al) content may be 0.045%.

Chromium (Cr): 3-4%

Chromium (Cr) may stabilize austenite in a range of an appropriate amount such that chromium (Cr) may contribute to improving impact toughness at low temperature, and may be solid-solute in austenite and may increase strength of the steel material. Also, chromium may effectively contribute to improving corrosion resistance of the steel material. Therefore, in the present disclosure, 3% or more of chromium (Cr) may be added to obtain the effect as above. However, chromium (Cr) may be a carbide-forming element and may form carbides on an austenite grain boundary, such that low-temperature impact toughness may be reduced. Thus, an upper limit of the chromium (Cr) content may be limited to 4% in consideration of content relationship between carbon (C) and other elements added together. Accordingly, the chromium (Cr) content in the present disclosure may be 3-4%, and a more preferable chromium (Cr) content may be 3-3.8%.

The cryogenic austenitic high-manganese steel material having excellent scale peelability according to an aspect of the present disclosure may further include, by weight %, one or more elements selected from among 1% or less of Cu (excluding 0%) and 0.0005-0.01% of B.

Copper (Cu): 1% or Less (Excluding 0%)

Copper (Cu) may stabilize austenite together with manganese (Mn) and carbon (C), and may effectively contribute to improving low-temperature toughness of the steel material. Also, copper (Cu) may have an extremely low solubility in carbides and may be slowly diffused in austenite, such that copper (Cu) may be concentrated on an interfacial surface between austenite and carbide and may surround a nuclei of fine carbide, thereby effectively inhibiting formation and growth of carbides caused by additional diffusion of carbon (C). Thus, in the present disclosure, copper (Cu) may be added to secure low-temperature toughness, and a preferable lower limit of the copper (Cu) content may be 0.3%. A more preferable lower limit of the copper (Cu) content may be 0.4%. When the copper (Cu) content exceeds 1%, hot workability of the steel material may be deteriorated, and in the present disclosure, an upper limit of the copper (Cu) content may be limited to 1%. Thus, the copper (Cu) content in the present disclosure may be 1% or less (excluding 0%), and a more preferable upper limit of the copper (Cu) content may be 0.7%.

Boron (B): 0.0005-0.01%

Boron (B) may be a grain boundary strengthening element which may strengthen an austenite grain boundary, and by even adding boron (B) in a small amount, an austenite grain boundary may be strengthened such that high-temperature cracking sensitivity may be effectively reduced. To obtain the effect as above, in the present disclosure, 0.0005% or more of boron (B) may be added. A preferable lower limit of the boron (B) content may be 0.001%, and a more preferable lower limit of the boron (B) content may be 0.002%. When the boron (B) content exceeds a certain range, segregation may occur on an austenite grain boundary such that high-temperature cracking sensitivity of the steel material may increase, and surface quality of the steel material may be degraded. Thus, in the present disclosure, an upper limit of the boron (B) content may be limited to 0.01%. A preferable upper limit of the boron (B) content may be 0.008%, and a more preferable upper limit of the boron (B) content may be 0.006%.

The cryogenic austenitic high-manganese steel material having excellent scale peelability according to an aspect of the present disclosure may further include a remainder of Fe and inevitable impurities in addition to the elements described above. In a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure. Also, addition of effective elements other than the above composition may not be excluded.

The cryogenic austenitic high-manganese steel material having excellent corrosion resistance according to an aspect of the present disclosure may include 95 area % or more of austenite as a microstructure, thereby effectively securing cryogenic toughness of the steel material. An average grain size of austenite may be 5-150 μm. An average grain size of austenite implementable in the manufacturing process may be 5 μm or more, and when the average grain size increases significantly, strength of the steel material may be reduced. Thus, the grain size of austenite may be limited to 150 μm or less.

The cryogenic austenitic high-manganese steel material having excellent corrosion resistance according to an aspect of the present disclosure may include carbide and/or ε-martensite as a possible structure other than austenite. When a fraction of carbide and/or ε-martensite exceeds a certain level, toughness and ductility of the steel material may be rapidly deteriorated. Thus, in the present disclosure, the fraction of carbide and/or ε-martensite may be limited to 5 area % or less.

The cryogenic austenitic high-manganese steel material having excellent corrosion resistance according to an aspect of the present disclosure may include a Cr concentration section continuously formed in an area within 50 μm from a surface in a thickness direction of the steel material. The Cr concentration section may refer to an area having a high Cr content as compared to the Cr content of the entire steel material.

The inventor of the present disclosure has conducted in-depth research on a Cr-added steel material in relation to a measure for improving corrosion resistance of a high manganese steel material, and as a result, it has been confirmed that, even when the same amount of Cr is added to the steel material, corrosion resistance properties may differ depending on the distribution of the Cr content in the Cr concentration section formed on the surface side of the steel material. In other words, in the case of Cr-added high manganese steel material, the Cr in steel may be concentrated in a surface layer of the steel material due to heating during the manufacturing process such that a Cr concentration section may be formed, and an aspect of Cr distribution in the Cr concentration section may be varied depending on heating conditions. Also, although it may be difficult to prove the exact mechanism, it has been indicated that, as for high manganese steel to which the same content of Cr is added, a steel material in which the Cr content in the Cr concentration section is uniformly distributed had further improved corrosion resistance properties as compared to a steel material in which a large amount of Cr is locally concentrated in the Cr concentration section. Therefore, the inventor of the present disclosure added Cr within an optimum range to secure corrosion resistance and low temperature properties of the steel material, and conducted an in-depth study on the surface layer Cr concentration conditions in which optimum corrosion resistance may be implemented even within the corresponding Cr content range, and completed the present disclosure.

The Cr concentration section in the present disclosure may be formed in an area within 50 μm in the thickness direction from the surface of the steel material, and may be continuously formed in the entire surface layer direction of the steel material. In other words, the Cr concentration section may include a case in which the Cr concentration section is formed directly below the surface of the steel material, and also a case in which the Cr concentration section is formed in contact with the surface of the steel material or is formed to form the surface of the steel material.

The Cr concentration section may include a high Cr concentration section in which Cr is concentrated in a relatively high concentration and a low Cr concentration section in which Cr is concentrated in a relatively low concentration. The high Cr concentration section may refer to an area including Cr by more than 1.5 times the Cr content of the steel material, and the low Cr concentration section may refer to an area including Cr by more than 1 time and 1.5 times or less the Cr content of the steel material. For example, in a steel material having the Cr content of 3.4% in the entire steel material, an area in which the Cr content is measured as 6% may be classified as the high Cr concentration section, and an area in which the Cr content is measured 4% may be classified as the low Cr concentration section. Also, since a heating process is essentially involved in the process of manufacturing the steel material, the surface layer of the steel material may exhibit a Cr content relatively higher than that of the entire steel material. Therefore, in the present disclosure, the Cr concentration section may refer to an area including Cr by more than 1 times as compared to the Cr content of the steel material. The Cr concentration in the surface layer of steel material may be measured with a scanning electron microscope (SEM). Also, the area fractions of the high Cr concentration section and the low Cr concentration section may be calculated from the results of observation using a scanning electron microscope.

On the surface of the steel material, when Cr is locally concentrated in a partial area of the surface portion, a relatively low concentration of Cr may be distributed in the other area of the surface portion. Therefore, a corrosion resistance effect may be relatively lowered in an area other than the area in which Cr is locally concentrated, and thus, it may be preferable to distribute Cr evenly in the surface layer of the steel material. In terms of securing corrosion resistance, preferably, the high Cr concentration section in the present disclosure may be provided in a fraction of 30 area % or less (excluding 0%) relative to the entire area of the Cr concentration section, and may be provided in a fraction of 10 area % or less more preferably.

The cryogenic austenitic high-manganese steel material having excellent corrosion resistance according to an aspect of the present disclosure may have tensile strength of 400 MPa or more, yield strength of 800 MPa or more, and elongation of 40% or more. Also, the cryogenic austenitic high-manganese steel material having excellent corrosion resistance according to an aspect of the present disclosure may have Charpy impact toughness of 90J or more (based on a 10 mm sample thickness) at −196° C., and corrosion loss of 80 mg/cm$^2$ or less in a corrosion resistance test according to ISO9223. Accordingly, both excellent cryogenic properties and excellent corrosion resistance properties may be provided.

Hereinafter, the manufacturing method in the present disclosure will be described in greater detail.

A method of manufacturing a cryogenic austenitic high-manganese steel material having excellent corrosion resistance according to an aspect of the present disclosure may include reheating a slab including, by weight %, 0.2-0.5% of C, 23-28% of Mn, 0.05-0.5% of Si, 0.03% or less of P, 0.005% or less of S, 0.5% or less of Al, 3-4% of Cr, and a balance of Fe and inevitable impurities, in a temperature range of 1050-1300° C.; hot-rolling the reheated slab at a finishing rolling temperature of 900-950° C., thereby providing an intermediate material; and cooling the intermediate material to a temperature range of 600° C. or less at a cooling rate of 1-100° C./s, thereby providing a final material.

Reheating Slab

Since the slab provided in the manufacturing method in the present disclosure corresponds to the steel composition of the austenitic high-manganese steel material described above, the description of the steel composition of the slab may be replaced with the description of the steel composition of the austenitic high-manganese steel material described above The slab provided in the above-described steel composition may be reheated in a temperature range of 1050-1300° C. When the reheating temperature is less than a certain range, there may be a problem in which an excessive rolling load may be applied during hot-rolling, or an alloy component may not be sufficiently solid solute. Therefore, in the present disclosure, a lower limit of the slab reheating temperature range may be limited to 1050° C. When the reheating temperature exceeds a certain range, grains may excessively grow such that strength of the steel material may be deteriorated, or the reheating may be performed by exceeding a solidus temperature of the steel material such that hot-rolling properties of the steel material may be deteriorated. Thus, an upper limit of the reheating temperature range may be limited to 1300° C.

Hot-Rolling

The hot-rolling process may include a rough-rolling process and a finishing rolling process, and the reheated slab may be hot-rolled and may be provided as an intermediate material. In this case, preferably, the finish hot-rolling may be performed in a temperature range of 900-950° C. When the finishing hot-rolling temperature is excessively low, mechanical strength may increase, whereas low-temperature impact toughness may be deteriorated, and thus, in the present disclosure, the finishing hot-rolling temperature may be limited to 900° C. or higher. Also, when the finishing hot-rolling temperature is excessively high, low-temperature impact toughness may improve, whereas the local Cr concentration tendency of the surface layer portion of the steel material may increase, and thus, in the present disclosure, the finishing hot-rolling temperature may be limited to 950° C. in terms of securing corrosion resistance.

Cooling

The hot-rolled intermediate material may be cooled to a cooling stop temperature of 600° C. or less at a cooling rate of 1-100° C./s. When the cooling rate is less than a certain range, a decrease in ductility of the steel material and deterioration of abrasion resistance may become problems due to carbides precipitated on a grain boundary during cooling, and thus, in the present disclosure, the rate of cooling the hot-rolled material may be limited to 10° C./s or more. The higher the cooling rate is, the more advantageous the effect of inhibiting carbide precipitation may be, but in consideration of a situation in which it may be difficult to implement a cooling rate exceeding 100° C./s in general cooling in terms of characteristics of facility, an upper limit of the cooling rate may be limited to 100° C./s in the present disclosure. Accelerated cooling may be applied to the cooling in the present disclosure.

Also, even when the intermediate material is cooled by applying a cooling rate of 10° C./s or more, when the cooling is stopped at a high temperature, it may be highly likely that carbides may be created and grown, and thus, in the present disclosure, the cooling stop temperature may be limited to 600° C. or less.

The austenitic high-manganese steel material manufactured as above may include a Cr concentration section continuously formed in an area within 50 μm from a surface in a thickness direction, the Cr concentration section may include a high Cr concentration section in which Cr is concentrated in a relatively high concentration and a low Cr concentration section in which Cr is concentrated in a relatively low concentration, and the high Cr concentration section may be distributed in a fraction of 30 area % or less (excluding 0%) relative to an entire surface area of the Cr concentration section.

Also, the austenitic high-manganese steel material manufactured as above may have tensile strength of 400 MPa or more, yield strength of 800 MPa or more, and elongation of 40% or more, and the steel material may have a Charpy impact toughness of 90 J or more (based on a 10 mm sample thickness) at −196° C., and corrosion loss of 80 mg/cm$^2$ or less in a corrosion resistance test according to ISO9223.

BEST MODE FOR INVENTION

Embodiment

A slab provided in the alloy composition as in Table 1 was prepared, and each sample was manufactured by applying the manufacturing process as in Table 2.

TABLE 1

| Classification | Alloy composition (weight %) | | | | | | | |
|---|---|---|---|---|---|---|---|---|
| | C | Si | Mn | Cr | P | S | Al | Cu |
| Steel type 1 | 0.46 | 0.33 | 24.0 | 3.42 | 0.013 | 0.002 | 0.024 | 0.50 |
| Steel type 2 | 0.45 | 0.28 | 24.1 | 3.21 | 0.014 | 0.001 | 0.024 | 0.43 |
| Steel type 3 | 0.42 | 0.26 | 23.9 | — | 0.018 | 0.002 | 0.028 | 0.38 |

As indicated in Tables 1 to 3, it has been indicated that samples 1 to 5 satisfying the alloy composition and the process conditions of the present disclosure satisfied yield strength of 400 MPa or more, tensile strength of 800 MPa or more, elongation of 40% or more, and Charpy impact toughness (based on 10 mm sample thickness) of 90 J or more at −196° C., and that the fraction of high Cr concentration section satisfied 30 area % or less, such that corrosion loss in the corrosion test of ISO9223 was 80 mg/cm$^2$ or less.

TABLE 2

| Sample No. | Classification | Heating slab | | Hot-rolling | | |
|---|---|---|---|---|---|---|
| | | Furnace temperature (° C.) | Discharging Temperature (° C.) | Finish rolling temperature (° C.) | Final thickness (mm) | Cooling rate (° C./s) |
| 1 | Steel type 1 | 1218 | 1169 | 900 | 25 | 25 |
| 2 | Steel type 2 | 1225 | 1172 | 910 | 24 | 21 |
| 3 | Steel type 1 | 1218 | 1165 | 925 | 38 | 26 |
| 4 | Steel type 2 | 1225 | 1160 | 942 | 24 | 19 |
| 5 | Steel type 2 | 1225 | 1162 | 918 | 22 | 21 |
| 6 | Steel type 3 | 1220 | 1158 | 890 | 25 | 23 |
| 7 | Steel type 3 | 1221 | 1160 | 932 | 25 | 22 |
| 8 | Steel type 3 | 1220 | 1160 | 959 | 22 | 22 |
| 9 | Steel type 2 | 1211 | 1154 | 969 | 40 | 20 |
| 10 | Steel type 2 | 1215 | 1161 | 852 | 40 | 21 |

Tensile properties and impact toughness of each sample were evaluated, and the results thereof are listed in Table 3. Tensile properties of each sample were evaluated by conducting a test at room temperature according to ASTM A370, and impact toughness was measured at −196° C. by processing into impact samples having a thickness of 10 mm according to the conditions of the same standard. Also, the Cr concentration section of the surface layer portion was observed using a scanning electron microscope (SEM) for each sample, and an area fraction of the high Cr concentration section relative to the surface area of the sample was calculated. Also, in accordance with the ISO9223 corrosion reduction test conditions, for each sample, a mild steel material standard sample and an each evaluation sample were exposed under wet conditions (50° C., 95% RH), corrosion was performed until the time point (takes 70 days) in which the corrosion amount of the mild steel material standard sample reach 1 year corrosion amount (52.5 mg/cm$^2$) of atmospheric corrosion, and corrosion loss of the evaluation sample was analyzed.

Samples 6 to 10 which did not satisfy any one or more of the alloy composition or the process conditions of the present disclosure did not satisfy any one or more of the physical properties.

While the example embodiments have been illustrated and described above, it will be apparent to those skilled in the art that modifications and variations could be made without departing from the scope of the present disclosure as defined by the appended claims.

The invention claimed is:

1. A cryogenic austenitic high-manganese steel material having excellent corrosion resistance, comprising:

by weight %, 0.2-0.5% of C, 23-28% of Mn, 0.05-0.5% of Si, 0.03% or less of P, 0.005% or less of S, 0.5% or less of Al, 3-4% of Cr, and a balance of Fe and inevitable impurities;

95 area % or more of austenite as a microstructure; and a Cr concentration section continuously formed in an area within 50 μm from a surface in a thickness direction, wherein the Cr concentration section includes a high Cr concentration section in which Cr is concentrated in a

TABLE 3

| Sample No. | Classification | Tensile properties | | | C direction | High Cr concentration | |
|---|---|---|---|---|---|---|---|
| | | Yield strength (MPa) | Tensile strength (MPa) | Elongation (%) | Impact toughness (J, @−196° C.) | section Fraction (area %) | Corrosion loss (mg/cm$^2$) |
| 1 | Steel type 1 | 485 | 868 | 57 | 105 | 6 | 55 |
| 2 | Steel type 2 | 454 | 867 | 56 | 106 | 7 | 59 |
| 3 | Steel type 1 | 483 | 872 | 59 | 108 | 11 | 62 |
| 4 | Steel type 2 | 446 | 852 | 54 | 103 | 14 | 67 |
| 5 | Steel type 2 | 471 | 878 | 57 | 98 | 13 | 65 |
| 6 | Steel type 3 | 441 | 858 | 55 | 96 | — | 105 |
| 7 | Steel type 3 | 425 | 851 | 56 | 101 | — | 112 |
| 8 | Steel type 3 | 325 | 782 | 60 | 112 | — | 118 |
| 9 | Steel type 2 | 351 | 792 | 66 | 125 | 37 | 91 |
| 10 | Steel type 2 | 590 | 945 | 39 | 82 | 8 | 57 |

relatively high concentration and a low Cr concentration section in which Cr is concentrated in a relatively low concentration, and wherein the high Cr concentration section is distributed in a fraction of 30 area % or less (excluding 0%) relative to an entire surface area of the Cr concentration section.

2. The steel material of claim 1, further comprising:

by weight %, one or more elements selected from among 1% or less of Cu (excluding 0%) and 0.0005-0.01% of B.

3. The steel material of claim 1, wherein the high Cr concentration section refers to an area including Cr by more than 1.5 times the Cr content of the steel material, and wherein the low Cr concentration section refers to an area including Cr by more than 1 time and 1.5 times or less the Cr content of the steel material.

4. The steel material of claim 1, wherein the high Cr concentration section is distributed in a fraction of 10 area % or less relative to an entire surface area of the Cr concentration section.

5. The steel material of claim 1, wherein a grain size of austenite is 5-150 μm.

6. The steel material of claim 1, wherein yield strength of the steel material is 400 MPa or more, wherein tensile strength of the steel material is 800 MPa or more, and wherein elongation of the steel material is 40% or more.

7. The steel material of claim 1, wherein the steel material has a Charpy impact toughness of 90J or more (based on a 10 mm sample thickness) at −196° C., and corrosion loss of 80 mg/cm$^2$ or less in a corrosion resistance test according to ISO9223.

8. The steel material of claim 1, comprising by weight %, 3-3.8% of Cr.

9. The steel material of claim 1, comprising by weight %, 0.001-0.01% of B.

10. The steel material of claim 1, comprising by weight %, 0.002-0.01% of B.

11. A method of manufacturing a cryogenic austenitic high-manganese steel material having excellent corrosion resistance, the method comprising:

reheating a slab including, by weight %, 0.2-0.5% of C, 23-28% of Mn, 0.05-0.5% of Si, 0.03% or less of P, 0.005% or less of S, 0.5% or less of Al, 3-4% of Cr, and a balance of Fe and inevitable impurities, in a temperature range of 1050-1300° C.;

hot-rolling the reheated slab at a finishing rolling temperature of 900-950° C., thereby providing an intermediate material; and cooling the intermediate material to a temperature range of 600° C. or less at a cooling rate of 1-100° C./s, thereby providing a final material.

12. The method of claim 11, wherein the slab further includes, by weight %, one or more elements selected from among 1% or less of Cu (excluding 0%) and 0.0005-0.01% of B.

13. The steel material of claim 1, comprising by weight %, 0.002-0.008% of B.

* * * * *